US005688323A

United States Patent [19]

Kane et al.

[11] Patent Number: 5,688,323

[45] Date of Patent: Nov. 18, 1997

[54] SPRAY CONTAINMENT AND ENCLOSURE ASSEMBLY

[75] Inventors: Marl Kane, Auburn; Clay Jorgensen, Stanwood; Don Sybil, Kent, all of Wash.

[73] Assignee: Interstate Coatings, Inc., Seattle, Wash.

[21] Appl. No.: 555,683

[22] Filed: Nov. 13, 1995

[51] Int. Cl.[6] ..... B05B 15/00; B24C 9/00

[52] U.S. Cl. ..... 118/326; 182/142; 182/2

[58] Field of Search ..... 118/500, 326; 182/143, 150, 129, 2; 51/410, 424, 426, 429

[56] References Cited

U.S. PATENT DOCUMENTS

| | | | |
|---|---|---|---|
| 2,998,094 | 8/1961 | Fisher | 182/142 |
| 4,429,764 | 2/1984 | Park | 182/129 |
| 4,649,672 | 3/1987 | Thomann | 51/424 |
| 4,825,598 | 5/1989 | Schlick | 51/410 |
| 4,854,419 | 8/1989 | Lyras et al. | 182/129 |
| 5,011,710 | 4/1991 | Harrison | 427/142 |
| 5,038,527 | 8/1991 | Fastje | 51/426 |
| 5,065,839 | 11/1991 | Napier | 182/47 |
| 5,067,504 | 11/1991 | Coleman, III | 134/172 |
| 5,427,199 | 6/1995 | Jorgensen et al. | 182/142 |

FOREIGN PATENT DOCUMENTS 119012 10/1944 Australia .

*Primary Examiner*—Donald E. Czaja
*Assistant Examiner*—Calvin Padgett
*Attorney, Agent, or Firm*—Seed and Berry LLP

[57] ABSTRACT

A spray containment enclosure assembly for use during the spraying operation on a work surface to prevent escape of airborne particles to the environment. The assembly includes a support arm, a personnel basket sized to receive a worker therein, a rigid enclosure attached to the personnel basket. The rigid enclosure is positioned with respect to the personnel basket such that when the worker is in the forward portion, at least a portion of an upper torso of the worker is within an interior area. The rigid enclosure has an open front side that is adapted to be positioned adjacent to the work surface to form an airway gap therebetween to allow air to flow into the interior area. A fan mounted to the rigid enclosure is adapted to create negative pressure in the interior area to draw air inwardly through the airway gap. An air filter is supported in the interior area and positioned to filter the air and removes particulates within the air from the air prior to the air being exhausted out of the interior area by the fan. A cross member extends across the interior area and has a recess that is covered by a yieldable skirt seal adapted to sealably engage an upper torso of the worker to block air from moving between the upper torso of the worker and the cross member. A flexible, air-impervious curtain is attached to the enclosure and positioned to substantially cover a rear wall opening and to sealably engage the rear portion of the worker's upper torso to block air flow from entering the interior area through the rear wall opening around the worker's upper torso. Air effectively enters only through the airway gap formed between the rigid enclosure and the work surface thereby preventing airborne particulates from exiting the interior area.

29 Claims, 5 Drawing Sheets

SPRAY CONTAINMENT AND ENCLOSURE ASSEMBLY

TECHNICAL FIELD

The present invention relates to work platforms and, more particularly, to work platform enclosures used during spraying operations on a work surface.

BACKGROUND OF THE INVENTION

Routine maintenance of large structures, such as bridges, ships and buildings has become prohibitively expensive for private owners as well as for state and federal government. Routine maintenance that can add many years to a structure's operational life includes cleaning, priming, painting, or other surface spray treatments. Many surface spray treatments create a substantial amount of airborne particulates resulting from over-spray and the release of paint or volatile components into the environment.

The airborne particulates from the over-spray of, as an example, paint, can inadvertently drift or fall onto surrounding structures, thereby requiring expensive and time-consuming cleaning or repainting of the surrounding structures. Further, the paint and its volatile components that enter the atmosphere can settle onto the surrounding structures and require remedial action. The common clean-up techniques used are often not sufficient to prevent contamination of the surrounding environment. Environmental concerns and regulations directly impact the expense of routine maintenance, and sometimes render the maintenance procedures economically infeasible.

Many processes have been attempted in the past to alleviate these problems. For example, paint containment enclosures have been attempted wherein a worker is contained within a containment enclosure during the entire spraying operation. While contained within the enclosure, the worker must be supplied with a breathing system, and the worker cannot exit the enclosure until the enclosure is removed from the work surface to a position allowing the worker to exit. Such work conditions are very strenuous and taxing on the worker. The conventional work platforms used for surface spray operations are movable, but such movement is not quick or convenient, and is not easily controlled by the worker on the platform. Adjusting the platform's position requires substantial time, manpower, communication, and coordination between the platform workers and the platform movers. The difficulty in moving and repositioning of the work platform results in a greater number of man-hours required to complete a job and thus results in a higher cost.

SUMMARY OF THE INVENTION

The present invention is directed toward a spray containment enclosure assembly that solves the problems that exist with conventional devices. In a preferred embodiment of the invention, the spray containment enclosure assembly includes a personnel basket directly supported by a support member, and a rigid enclosure removably carried by the personnel basket. The rigid enclosure defines an interior area and the personnel basket is exterior of the interior area. The personnel basket has a forward portion and a rearward portion, and the personnel basket is sized to allow a worker in the personnel basket to move between the forward and rearward positions. A rear wall of the rigid enclosure is located between the forward and rearward portions of the personnel basket. The rear wall has an opening therein shaped and sized to allow at least the upper torso of the worker to move into and out of the enclosure's interior area when the worker moves between the forward and rearward portions of the personnel basket. The enclosure has an open front side opposite the rear wall, and the open front side is adapted to be positioned adjacent to a work surface so as to form an airway gap between the open front side of the enclosure and the work surface extending about the perimeter of the enclosure at the open front side. The open front side defines an access opening providing direct access to the work surface from the enclosure's interior area.

An air filter support is attached to the enclosure and spans across the interior area of the enclosure. The air filter support includes a support grate that slopes upwardly and rearwardly from the open front side toward the rear wall. An air filter is removably attached to the air filter support and is supported at an angle by the grate. The air filter also spans across the width of the enclosure's interior area. An air moving device, such as a fan, is attached to the enclosure at a position with the air filter between the fan and the enclosure's open front side. The fan draws air into the interior area through the airway gap to create an inward airflow that prevents the airborne particulates that are emitted during the spraying operation from exiting the interior area through the airway gap The fan draws air through the air filter, where airborne particulates are collected.

A shelf-like cross member extends across the interior area of the rigid enclosure above the forward portion of the personnel basket to form a generally flat, horizontal structure within the enclosure. The cross member has a rear edge portion with a forwardly projecting recess that is shaped and sized to receive therein at least a front portion of a torso of the worker during a spraying operation when the worker is in the forward portion of the personnel basket and in a working position. A yieldable skirt seal extends across the recess and is positioned to elastically deflect forwardly, and sealably engage the front portion of the worker's torso when the worker is in the working position. The skirt seal provides an airflow barrier between the worker's torso and the cross member during the spraying operation.

A flexible cover member, such as an air-impervious curtain, is attached to the rigid enclosure and positioned to substantially cover the opening in the rear wall. The cover member is movable relative to the enclosure to allow the worker to move through the opening between the forward and the rearward portions of the personnel basket. The cover member is positioned to sealably engage the rear wall of the enclosure around the opening to form a seal therebetween. The cover member is sufficiently flexible to sealably engage a rear portion of the worker's torso when the worker is in the working position to substantially block air from being drawn by the fan through the opening and into the enclosure's interior area. Accordingly, the air drawn into the interior area of the enclosure enters substantially exclusively through the airway gap and prevents any airborne particulates resulting from the spraying operation from exiting the enclosure through the airway gap.

DETAILED DESCRIPTION OF THE INVENTION

Figure 1:
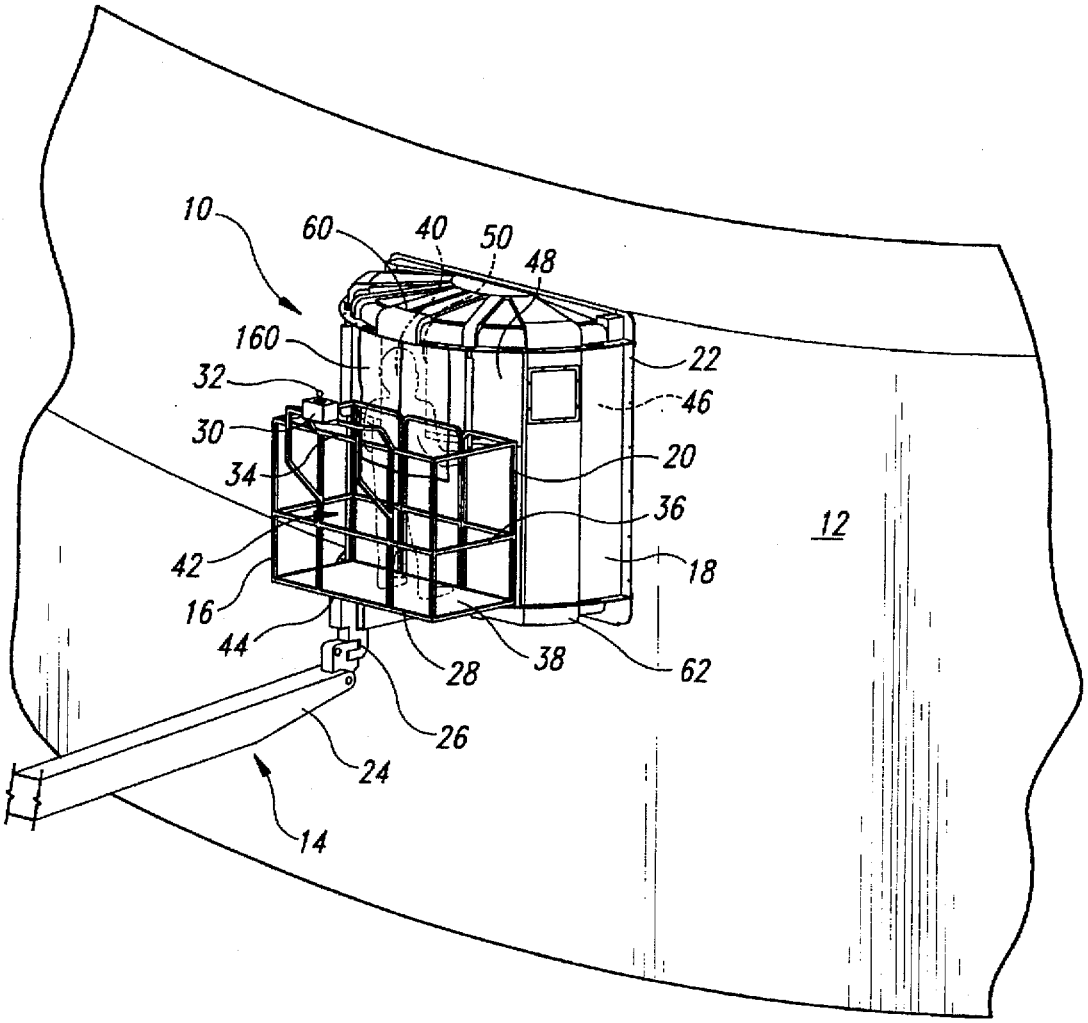
FIG. 1 is a perspective rear view of a spray containment enclosure assembly in accordance with the present invention, with an open front side of a rigid spray containment enclosure shown positioned adjacent to a work surface.

A spray containment enclosure assembly 10 in accordance with the present invention is shown in the drawings for purposes of illustration. As shown in FIG. 1, the spray containment enclosure assembly 10 is used in a spraying operation of a work surface 12 of a structure, such as a ship, building, water tank, or bridge, and includes a positionable support arm 14 that directly supports a personnel basket 16 of conventional design. A rigid enclosure 18 is removably carried by a forward portion 20 of the personnel basket 16, such that the rigid enclosure and the personnel basket are movable as a unit by the support arm 14 to position the rigid enclosure adjacent to the work surface 12 with a peripheral airway gap 22 therebetween. The spray containment enclosure assembly 10 is adapted to draw air into the rigid enclosure 18 through the airway gap 22 to prevent airborne particulates in the air within the rigid enclosure from exiting through the airway gap, thereby containing within the rigid enclosure 18 any over-spray or airborne particulates resulting from the spraying operation. The air is filtered within the rigid enclosure 18 to remove the particulates, and the filter air is exhausted from the rigid enclosure to the ambient air.

Figure 2:
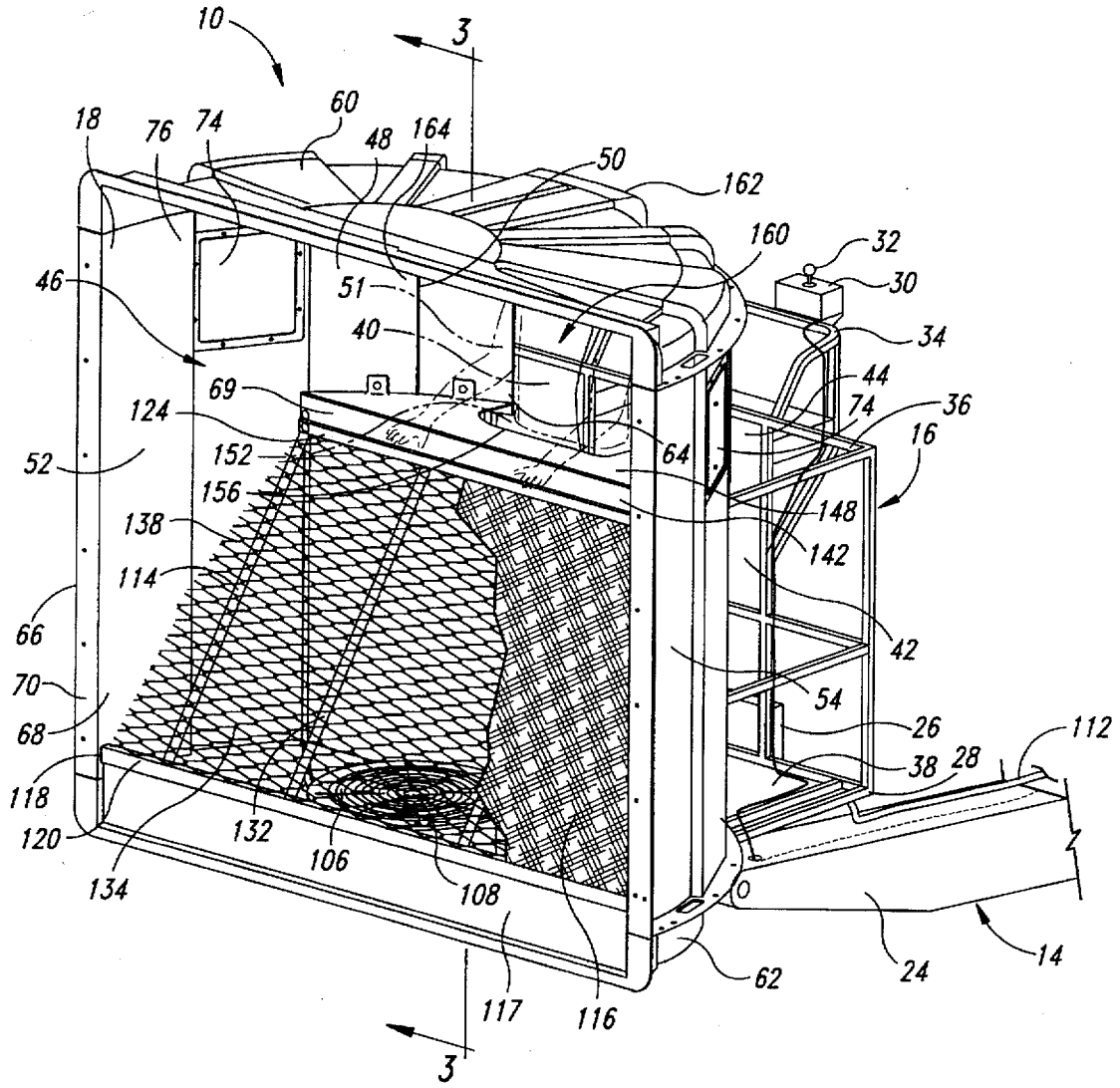
FIG. 2 is an enlarged fragmentary front isometric view of the spray containment enclosure assembly of FIG. 1 illustrated removed from the work surface, and a worker is illustrated in phantom lines standing in a personnel basket in a working position with the worker's torso being within an interior area of the rigid enclosure.
Figure 3:
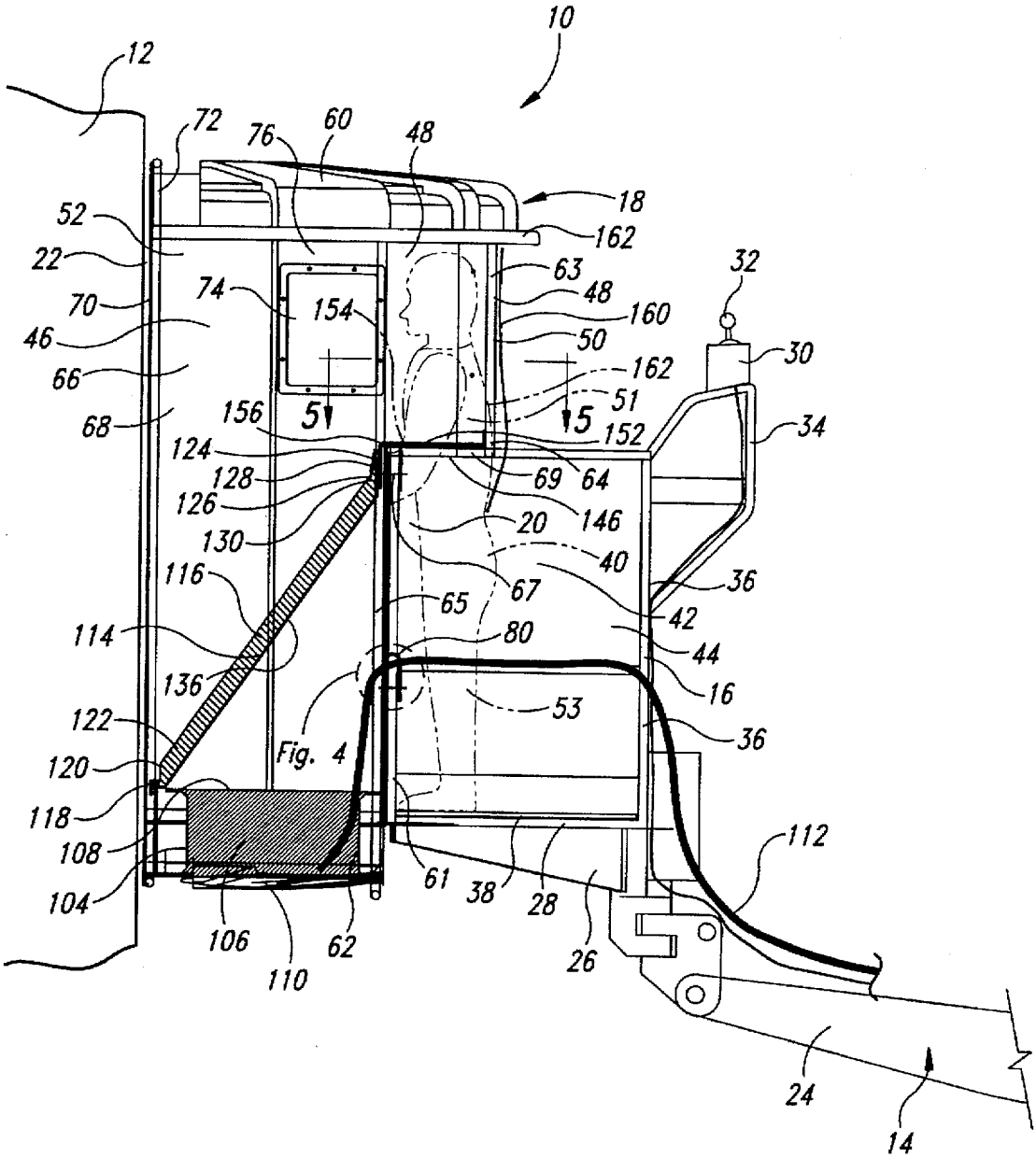
FIG. 3 is a cross-sectional view taken substantially along line 3—3 of FIG. 2, illustrating the rigid enclosure adjacent to the work surface with an airway gap therebetween.

As best seen in FIGS. 1, 2, and 3, the support arm 14 is a hydraulic boom arm having an outer arm section 24 movably connected to a basket support structure 26. The basket support structure 26 is rigidly attached to a bottom portion 28 of the personnel basket 16, such that movement of the basket support structure moves the personnel basket. The basket support structure 26 is rotatable relative to the outer arm section 24 of the support arm 14 to allow the basket support structure and personnel basket 16 to rotate and move as a unit relative to both the outer support arm and the work surface 12.

A control device 30 is mounted to the personnel basket 16 such that a worker 40 can operate the control device while standing in the personnel basket 16. In the illustrated embodiment, the control device 30 includes a conventional joystick-type control member 32 mounted to a rear railing structure 34 of the personnel basket 16. The control device 30 is operatively connected to a hydraulic system (not shown) of the positionable support arm 14 for selectively adjusting the position of the support arm, the personnel basket 16, and the rigid enclosure 18 relative to the work surface 12.

As best seen in FIGS. 2 and 3, the personnel basket 16 of the illustrated embodiment is constructed of a plurality of tubular sections 36 welded or otherwise securely interconnected together as a railing around a standing plate 38 on which the worker 40 stands. The tubular sections 36 and the standing plate 38 define a working area 42 in the personnel basket 16 that receives and contains the worker 40 therein during the spraying operation. The personnel basket 16 has a rearward portion 44 opposite the forward portion 20, with the forward portion being closer to the work surface 12 (FIG. 3) than the rearward portion during the spraying operation. The personnel basket 16 is sized to allow the worker 40 to move about the work area 42 between the forward and rearward portions, 20 and 44, respectively, during the spraying operation.

The personnel basket 16 removably carries the rigid enclosure 18 such that the forward portion 20 of the personnel basket 16 is contained within an interior area 46 of the rigid enclosure, and the rearward portion 44 of the personnel basket is exterior of the enclosure's interior area. A rear wall 48 of the rigid enclosure 18 is positioned between the forward and rearward portions 20 and 44 of the personnel basket 16. The rear wall 48 has an opening 50 therein shaped and sized to allow the worker 40 to move between the forward and rearward portions 20 and 44 of the personnel basket 16, thereby moving into and out of the interior area 46 of the rigid enclosure 18 as desired to complete the spraying operation.

During the spraying operation, the worker 40 stands in a working position on the standing plate 38 in the forward portion 20 of the personnel basket 16 (as shown by the worker illustrated in FIGS. 2 and 3). In the working position, a torso 51 of the worker 40 is substantially within the interior area 46 of the rigid enclosure 18 to conduct the spraying operation. As discussed in detail below, the worker's lower body 53 is exterior of the interior area, and a seal is created between the worker's torso 51 and rigid enclosure 18 to block air from being drawn around the torso and into the enclosure. The work area 42 of the personnel basket 16 is sized so the worker 40 can move rearwardly away from the working position, and through the rear wall opening 50, and to the rearward portion 44 of the personnel basket 16, thereby moving out of the interior area 46 of the rigid enclosure 18. Thus, the worker 40 can easily, quickly and safely move out of the interior area 46 and into the fresh air without having to move the personnel basket 16 or support arm 14 away from to the work surface 12. When the worker 40 is standing in the rearward portion 44 of the personnel basket 16, the worker can see portions of the work surface 12 that have been the subject of the spraying operation or that will be the subject of the spraying operation. In addition, the worker 40 can use the control device 30 to control the position of the spray containment enclosure assembly 10 relative to the work surface 12 as desired to continue the spraying operation.

In the illustrated embodiment, the personnel basket 16 and the rigid enclosure 18 are supported by the support arm 14. In an alternate embodiment, the personnel basket 16 is supported by support cables (not shown) that extend upwardly to a conventional trolley assembly or the like that is positionable with respect to the work surface 12 so as to operatively adjust the position of the rigid enclosure 18 and the personnel basket 16 with respect to the work surface.

As best seen in FIGS. 2 and 3, the rigid enclosure 18 is a semi-cylindrical structure that is removably carried by the tubular sections 36 at the forward portion 20 of the personnel basket 16. The rigid enclosure 18 includes a curved right sidewall 52, which is located to the right of the worker 40 when standing in the working position, and a curved left sidewall 54, which is located to the left of the worker when in the working position. The rear wall 48 extends between the right and left sidewalls 52 and 54. The rear wall 48 is securely attached to the right and left sidewalls 52 and 54 by conventional fasteners. A semi-circular top wall 60 is securely connected to an upper end of the right sidewall 52, the left sidewall 54, and the rear wall 48 by conventional fasteners. The right sidewall 52 and the left sidewall 54 extend downwardly from the top wall 60 and terminate at lower ends 61 that are just below the standing plate 38. A bottom wall 62 is securely fastened to a lower end of the right and left sidewalls 52 and 54 opposite the top wall 60.

As best seen in FIG. 3, the rear wall 48 has a curved rear upper wall portion 63 and a flat rear lower wall 65. The rear upper wall portion 63 is secured at an upper end to the top wall 60 and extends downwardly to a bottom edge 64 in a position that approximately corresponds with the top rail tube of the tubular section 36 of the personnel basket 16. The bottom edge 64 of the rear upper wall portion 63 is located between the forward portion 20 and the rearward portion 44 of the personnel basket 16. The rear lower wall portion 65 is securely connected along its sides to the right and left sidewalls 52 and 54, and connected at a bottom end to the bottom wall 62 forwardly adjacent to the standing plate 38. The rear lower wall portion 65 extends upwardly and terminates at a top edge 67 forwardly adjacent to the top rail tube of the tubular sections 36 of the personnel basket 16. Accordingly, the top edge 67 of the rear lower wall portion 65 is at approximately the same height relative to the personnel basket 16 as the bottom edge 64 of the rear upper wall portion 63, but the rear lower wall portion is forwardly offset from the rear upper wall portion with a space between the top edge 67 and the bottom edge 64. As discussed in greater detail below, a substantially horizontal, shelf-like cross member 69 extends between and is securely fastened to the top edge 67 of the rear lower wall portion 65 and the bottom edge 64 of the rear upper wall portion 63.

The right sidewall 52, the left sidewall 54, the top wall 60, and the bottom wall 62 have forward edges 66 that interconnect to define the perimeter of an open front side 68 of the rigid enclosure 18 that is opposite the rear wall 48. The open front side 68 provides the worker 40 with direct access to the work surface 12 from the interior area 46 of the rigid enclosure 18 when the worker is in the working position. The forward edges 66 have a substantially flat front flange 70 that is adapted to be positioned adjacent to the work surface 12 (FIG. 3) during the spraying operation to define the airway gap 22 between the rigid enclosure 18 and the work surface 12. A rigid support tube 72 is connected to the right sidewall 52, the left sidewall 54, the top wall 60 and the bottom wall 62, rearward of and adjacent to the forward edges 66 thereof The rigid support tube 72 extends around the perimeter of the open front side 68 of the rigid enclosure 18 to provide additional structural support at the front of the enclosure.

The rigid enclosure 18 of the preferred embodiment is constructed of a substantially translucent material, such as polyethylene (cross-linked or high density) that provides a substantially rigid structure while allowing light to enter the rigid enclosure's interior area 46 to enhance the visibility within the interior area during the spraying operation. As best seen in FIG. 2, each of the right and left sidewalls 52 and 54 include a transparent view port 74 in the upper portion 76 of the sidewall and adjacent to the top wall 60. The view ports 74 are positioned to allow the worker 40 to see out of the rigid enclosure 18 when the worker is in the interior area 46 and in the working position. The view ports 74 also allow light to enter into the rigid enclosure 18 to further enhance visibility during the spraying operation.

Figure 4:
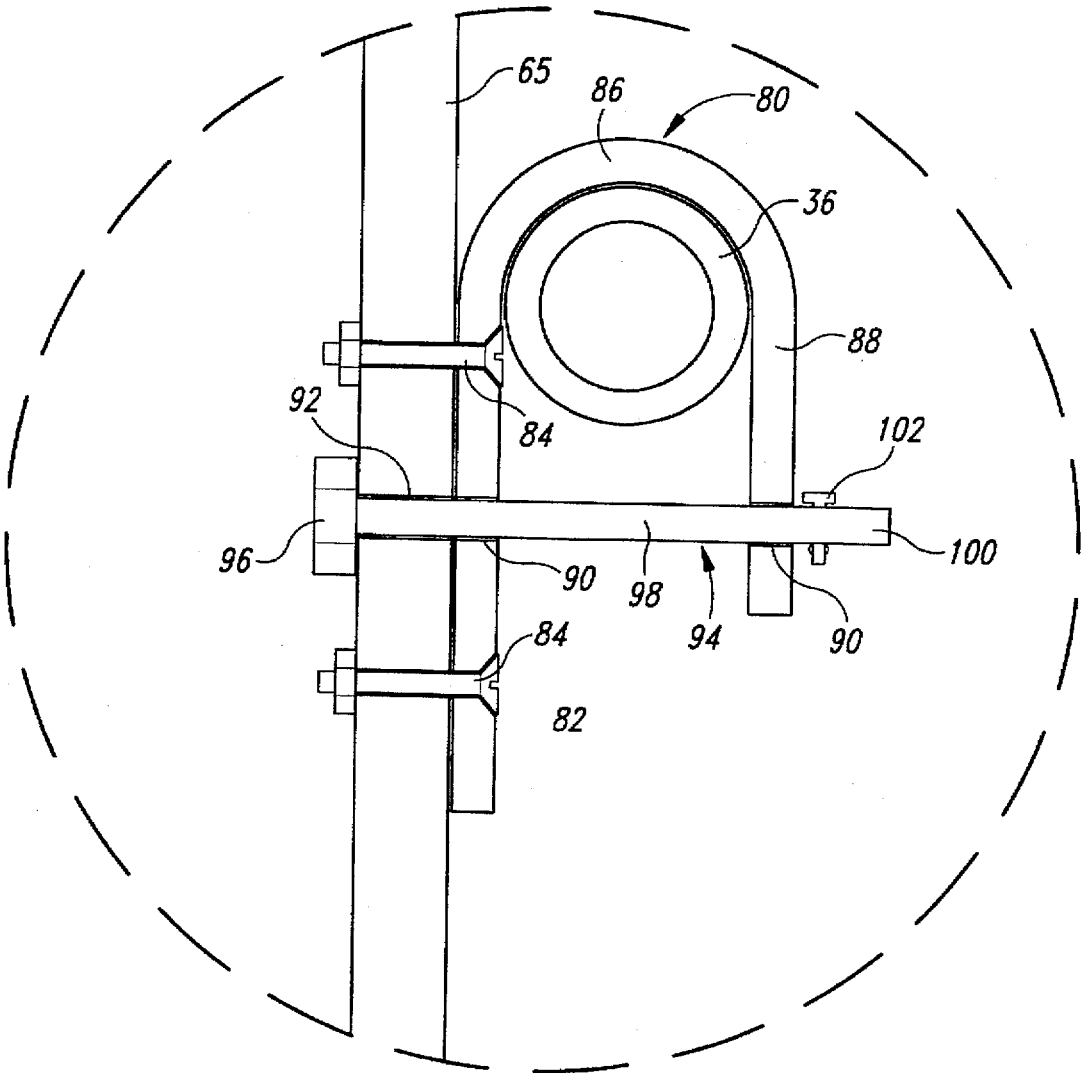
FIG. 4 is an enlarged, fragmentary side view of a platform hook bracket connecting the rigid enclosure to the personnel basket.

The rigid enclosure 18 is a lightweight structure that is removably retained on the personnel basket 16. The rear lower wall portion 65 has a plurality of platform hanger hooks 80 securely fastened thereto to lockably engage selected forward tubes of the tubular sections 36 of the personnel basket 16. As best seen in FIG. 4, each of the platform hooks 80 is an inverted U-shaped member having a first leg 82 securely attached to the rear lower wall portion 65 by a pair of conventional fasteners 84. The first leg 82 is integrally connected to a curved upper portion 86 of the platform hook 80. The curved upper portion 86 is shaped to extend around and rest on a selected tube of the tubular sections 36. A second, free leg 88 of the platform hook 80 extends downwardly from the curved upper portion 86 opposite the first leg 82. The first leg 82 and the second, free leg 88 have coaxially aligned apertures 90 that are aligned with a similarly sized aperture 92 in the rear lower wall portion 65. These aligned apertures 90 and 92 removably receive a locking pin 94 therethrough with the selected tube of the tubular sections 36 being captured between the locking pin and the curved upper portion 86 of the platform hook 80, thereby locking the platform hook 80 onto the selected tubular section of the personnel basket 16.

The locking pin 94 of the illustrated embodiment has an enlarged head portion 96 that engages the rear lower wall portion 65 opposite the first leg 84 of the platform hook 80. A shank 98 of the locking pin 94 extends through the apertures 90 and 92, and a free end 100 of the shank extends past the second, free leg 88. A friction-retaining pin 102 extends through the free end 100 of the locking pin 94 outward of and adjacent to the second free leg 88 of the platform hook 80, so as to prevent the locking pin from being inadvertently removed.

Accordingly, the rigid enclosure 18 is easily and quickly removed from the personnel basket 16 by removing the friction-retaining pins 102 from the locking pins 94 and removing the locking pins from the platform hooks 80 for the rear lower wall portion 65. Thereafter, the rigid enclosure 18 is lifted upward until the platform hooks 80 are lifted off of the respective tubes of the tubular sections 36 of the personnel basket 16 upon which they were hung, allowing the rigid enclosure 18 to be moved forward and away from the personnel basket to a desired location.

In the illustrated embodiment of FIG. 3, the bottom wall 62 of the rigid enclosure 18 has an exhaust aperture 104 that has a fan 106 mounted therein. The fan 106 is positioned to draw air into the interior area 46 through the airway gap 22. The fan 106 of the illustrated embodiment is operatively connected to the control device 30 on the personnel basket 16 such that the worker 40 can activate and deactivate the fan while standing in the rearward portion 44 of the personnel basket 16. The air drawn into the interior area 46 through the airway gap 22 is drawn by the fan 106 through an air filter 116 and is exhausted to the ambient air exterior of the rigid enclosure 18. The fan 106 is secured to the bottom wall 62 such that an upper intake portion 108 of the fan is positioned above the bottom wall within the interior area 46. A lower discharge portion 110 of the fan 106 is positioned below the bottom wall 62 so as to exhaust air out of the interior area 46 of the rigid enclosure into the ambient air.

In the illustrated embodiment, the fan 106 is an air-powered reaction fan that utilizes pressurized air to drive the fan blades, rather than electricity, thereby avoiding the risk of creating an electric spark within the interior area 46 of the rigid enclosure during the spraying operation. As best seen in FIG. 3, a pressurized air hose 112 is operatively attached at one end to the fan 106, and the opposite end (not shown) of the air hose is attached to a pressurized air source (not shown). The preferred air-powered reaction fan 106 for the illustrated embodiment has a capacity of approximately 11,000 cubic feet per minute (cfm) of airflow. Other fans having greater or lesser capacity may be used as needed for a desired airflow into the interior area. In addition, other air moving devices can be used to draw air into the interior area 46 through the airway gap 22 and out an exhaust port.

In the illustrated embodiment of FIG. 3, the rigid enclosure 18 is shown positioned adjacent to the work structure 12 such that the airway gap 22 is approximately one inch wide. This one inch airway gap 22 extends around the entire perimeter of the open front side 68 of the rigid enclosure 18 at the forward edges 66 thereof and allows a significant flow of air, such as approximately 11,000 cfm, to be drawn into the rigid enclosure 18. This air flow through the airway gap 22 is sufficient to prevent particulates sprayed into the air within the interior area 46 during the spraying operation from exiting the rigid enclosure 18 through the airway gap, thereby containing the particulates, and preventing them from entering the environment.

The air drawn into the interior area 46 of the rigid enclosure 18 is filtered to remove the particulates before the air is exhausted through the fan 106. The spray containment enclosure assembly 10 includes an angled filter support 114 that removably retains the air filter 116 in a position such that the air must pass through the air filter before being exhausted by the fan 106. As best seen in FIG. 2, the filter support 114 is attached to the right and left sidewalls 52 and 54 and extends across the interior area 46 above the fan 106. The filter support 114 has a lower, forward retaining member 118 spanning between the right and left sidewalls 52 and 54 across the open front side 68 and extending upwardly from the bottom wall 62. The lower, forward retaining member 118 includes a vertically oriented lower support plate 117 securely fastened to the bottom wall 62 and the right and left sidewalls 52 and 54 rearward of and adjacent to the open front side 68. Accordingly, the lower support plate 117 is positioned forward of and adjacent to the upper intake portion 108 of the fan 106. The forward retaining member 118 has a vertically oriented retaining lip 120 attached to an upper portion of the lower support plate 117. The retaining lip extends along the length of the lower support plate 117 between the right and left sidewalls 52 and 54 so as to removably retain a bottom edge portion 122 of the air filter 116.

The filter support 114 has an upper, rearward retaining member 124 that is securely attached to the cross member 69 at a height above the lower, forward retaining member 118. The rearward retaining member 124 extends substantially horizontally between the right and left sidewalls 52 and 54 across the interior area 46. The rearward retaining member 124 includes a support plate 126 extending along its length, and a stiff, yet flexible, retaining blade 128 that extends downwardly over the length of the support plate. The retaining blade 128 is adapted to extend over an upper edge portion 130 of the air filter 116 and press the air filter upper edge portion against the support plate 126, thereby removably retaining the upper edge portion against the rearward retaining member 124.

In the preferred embodiment, the support plate 126 of the rearward retaining member 124 has a plurality of retaining pins (not shown) positioned along the length of the support plate to engage and pierce through the upper edge portion 130 of the air filter 116. The retaining pins securely and removably retaining the air filter 116 in place on the rearward retaining member 124.

As best seen in FIG. 2, the filter support 114 includes a plurality of support stringers 132 extending upwardly and rearwardly from the lower, forward retaining member 118 to the upper, rearward retaining member 124. A support grate 134 is supported along the lengths of the support stringers 132. The support grate 134 is a diamond-patterned grate having a plurality of openings through which air can easily pass. The support grate 34 extends between the right and left sidewalls 52 and 54 so as to form a grate structure above the fan 106 and across the entire area between the right and left sidewalls and the lower, forward and upper, rearward retaining members 118 and 124. The support grate 134 and the support stringers 132 provide support for a middle portion 136 of the air filter 116. The support grate 134 has side portions 138 that are shaped to correspond to the curved shape of the curved fight and left sidewalls 52 and 54 so as to follow the contour of the rigid enclosure 18 between the forward retaining member 118 and the rearward retaining member 124.

The air filter 116 is a fiberglass filter that has a shape corresponding to the shape of the support grate 134 such that the air filter extends across the entire interior area 46 between the forward retaining member 118 and the rearward retaining member 124, and between the right and left sidewalls 52 and 54, thereby creating a filtering barrier between the open front side 68 of the rigid enclosure 18 and the fan 106.

The fiberglass air filter 116 of a preferred embodiment is disposable and is adapted to remove paint particulates from air drawn through the filter by the fan 106. The air filter 116 is supported at an angle sloping upwardly and rearwardly from its bottom edge portion 122 so as to maximize the surface area of the air filter, and thus the filtering area, while using a flat filter fully positioned within the interior area 46 of the rigid enclosure 18. When the air filter 116 is filled to the point where filtration is no longer effective, the air filter is quickly and easily removed from the filter support 114, disposed of, and a new filter is installed on the filter support.

Accordingly, when the spray containment enclosure assembly 10 is positioned adjacent to the work surface 12 such that the airway gap 22 is formed between the rigid enclosure 18 and the work surface, and the fan 106 is activated by the worker 40, the fan draws air from outside of the rigid enclosure through the airway gap and into the interior area 46. The airflow in the interior area 46 draws the air and airborne particulates, such as paint or the like, within the interior area to the air filter 116. The air passes through the filter so as to filter the particulates out of the air. The filtered air is then pulled into the upper intake portion 108 of the fan 106 and exhausted out the lower discharge portion 110 of the fan to the ambient air exterior of the rigid enclosure 18. Accordingly, the particulates in the air within the interior area 46 are retained within the interior area and do not escape through the airway gap 22 to the environment.

Figure 5:
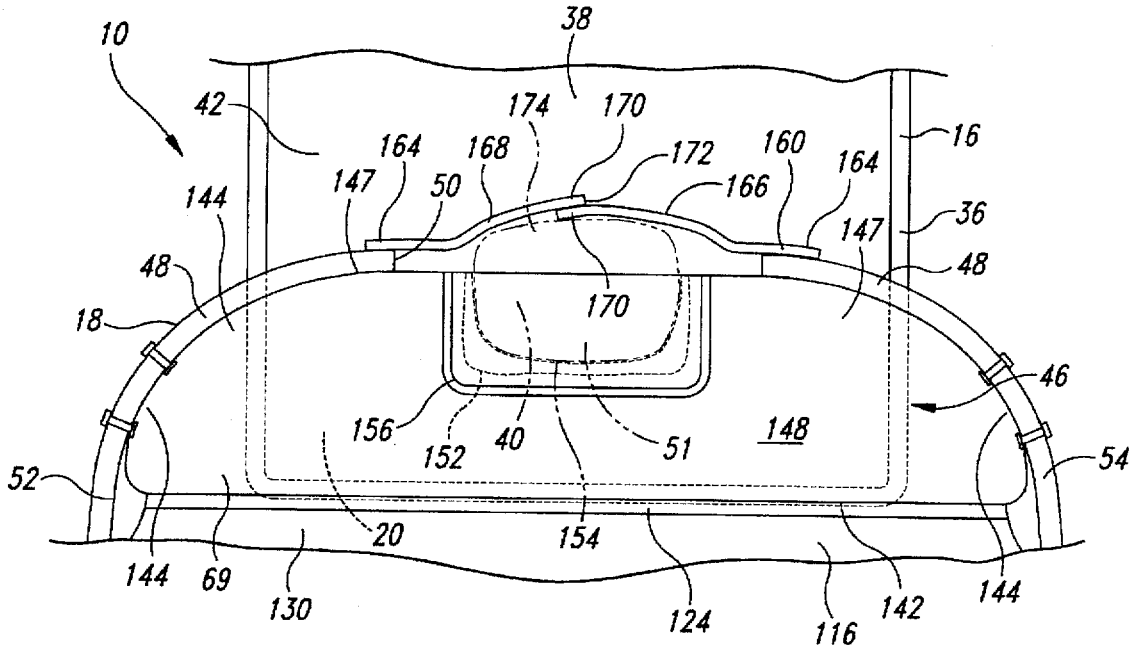
FIG. 5 is an enlarged cross-sectional view taken substantially along line 5—5 of FIG. 3 illustrating a cross member extending across the interior area of the rigid enclosure with a skin seal illustrated in solid lines spanning across a recess in the cross member, and the skirt seal illustrated in phantom lines in a forwardly deflected position along with the torso of the worker also illustrated in phantom lines in the working position.

As best seen in FIGS. 2 and 5, the cross member 69 combines with the rear upper wall portion 63, the rear lower wall portion 65, the right sidewall 52, the left sidewall 54, the top wall 60, and the bottom wall 62 to define the interior area 46 of the rigid enclosure 18. The cross member 69 has a substantially straight front edge 142 that extends across the entire interior area 46 between the right and left sidewalls 52 and 54, and that is securely connected to the top edge 67 of the rear lower wall portion 65. In the illustrated embodiment, the rearward retaining member 124 is fastened to the front edge 142 of the cross member 69 such that the air filter 116 extends downwardly and forwardly from the front edge to the lower, forward retaining member 118 at the open front side 68. Accordingly, air cannot flow between the front edge 142 and the air filter 116 without passing through the air filter.

The cross member 69 has curved right and left rearward edges 144 extending rearwardly from the front edge 142. The right and left rearward edges 144 follow the curved contours of the rear upper wall portion 63. The right and left rearward edges 144 are securely fastened to the rear upper wall portion 63 adjacent to the bottom edge 64 to prevent airflow therebetween. The cross member 36 is positioned over the forward portion 20 of the personnel basket 16.

The cross member 69 has a relatively horizontal, flat upper surface 148 that provides a shelf-like surface on which equipment, supplies, or the like may be stored or temporarily placed during the spraying operation. The flat upper surface 148 also provides an area upon which the worker can rest or support an arm or hand during the spraying operation to minimize fatigue. In a preferred embodiment, the cross member 69 is a molded, rigid plastic structure that provides the shelf-like surface while maintaining a lightweight component of the rigid enclosure 18 so as to provide for an overall lightweight spray containment assembly 10.

In the embodiment illustrated in FIGS. 2 and 3, the cross member 69 is positioned at a height in the interior area 46 that substantially corresponds to the torso 51 of the worker 40. A central rear edge 147 of the cross member 69, extending between the right and left rearward edges 144, has a forwardly projecting recess 152 that is shaped and sized to receive therein at least a front portion 154 of the worker's torso 51 during the spraying operation when the worker 40 is in the working position. Accordingly, at least the upper portion of the worker's torso 51 is within the interior area when the worker is in the working position and standing in the forward portion 20 of the personnel basket 16. The worker's legs and lower body are rearward of and adjacent to the rear lower wall portion 65, and thus exterior of the interior area 46 of the rigid enclosure 18.

As best seen in FIG. 5, a yieldable skin seal 156 is removably attached to the cross member 69 at a plurality of positions around the recess 152 so as to span across substantially the entire recess when the skin seal is in an undeflected position, shown in solid lines, as occurs when the worker 40 is not in the working position. The skin seal 156 is adapted to elastically deflect forwardly from the undeflected position to a deflected position, illustrated in phantom lines so as to engage the front portion 152 of the worker's torso 51 when the worker 40 moves into the recess 152 and into the working position. In the deflected position, the skirt seal 156 sealably engages the front portion 154 of the worker's torso 51 to substantially block any air from flowing between the worker's torso and the central rear edge 147 of the cross member 69.

The yieldable skirt seal 156 is constructed of a flexible material, such as cloth, attached along its rearward edge to an elastic cord extending across the rearward opening of the recess 152 so that it is biased to the undeflected position. As such, when the worker 40 moves rearwardly away from the working position, the skin seal moves rearwardly from the deflected position to the undeflected position. Accordingly, an airflow barrier is provided between the front portion 154 of the worker's torso 51 and the cross member 69 such that airflow into the interior area 46 is substantially through the airway gap 22.

As discussed above, the rear wall 48 of the rigid enclosure 18 illustrated in FIG. 3 has the rear wall opening 50 in the rear upper wall portion 65 that is sized to allow the worker 40 to move between the rearward portion 44 and the forward portion 20 of the personnel basket 16, thereby moving the worker's upper torso 51 into and out of the interior area 46 of the rigid enclosure 18. As best seen in FIGS. 3 and 5, the rear wall opening 50 is substantially covered by a two-piece flexible curtain 160 sealably connected to a rearward portion 162 of the top wall 60 (FIG. 3) above the rear wall opening. The curtain 160 comprises two flexible sheets of substantially air-impermeable, transparent plastic material having a combined width greater than the rear wall opening 50. The transparency of the curtain 160 allows light to enter into the interior area 46 of the rigid enclosure 18, to facilitate lighting therein and enhance visibility for the worker 40 performing the spraying operation. The curtain 160 has outer edge portions 164 positioned immediately adjacent to the rear upper wall portion 63 around the rear wall opening 50 along the entire height of the rear wall opening. In the preferred embodiment, the curtain 160 extends downwardly beyond the bottom edge 64 (FIG. 3) of the rear upper wall portion 65 to terminate at a position below the worker's upper torso 51 when the worker 40 is standing in the working position.

The curtain 160 of the illustrated embodiment has a left curtain section 166 and a fight curtain section 168 that extend toward each other from their outer edge portions 164. The left and right curtain sections 166 and 168 have inner edge portions 170 that overlap each other to form a sealable slit 172 in the middle of the curtain 160. Accordingly, the left and right curtain sections 166 and 168 are separable at their inner edge portions 170 to allow the curtain sections to be moved apart so the worker 40 can easily move to and from the working position in the forward portion 20 of the personnel basket 16.

When the worker 40 is in the working position, as shown in phantom lines in FIG. 5, the left and right curtain sections 166 and 168 have a sufficient flexibility to engage a rearward portion 174 of the worker's upper torso 51. When the fan 106, illustrated in FIG. 3, is activated, the fan creates a negative pressure within the interior area 46 of the rigid enclosure 18 so as to draw air into the interior area 46 through the airway gap 22. The negative pressure in the interior area 46 also draws the left and right curtain sections 166 and 168 toward the interior area so as to cause the outer portions 164 of the left and right curtain sections to sealably engage the rear upper wall portion 63 around the rear wall opening 50. In addition, the leer and fight curtain sections 166 and 168 are pulled into sealable engagement with the rearward portion 174 of the worker's upper torso 51, with the overlapping inner edge portions 170 sealably engaging each other.

Accordingly, the curtain 160 substantially blocks air from being drawn into the interior area 46 through the rear wall opening 50, and around the worker 40. Air is also prevented from entering the interior area 46 by the sealable engagement of the user's upper torso 51 with the yieldable skirt seal 156, as discussed above. As a result, the air drawn into the interior area 46 effectively enters only through the airway gap 22, thereby preventing the particulates within the interior area 46 from moving out of the interior area through the airway gap. Instead, the particulates are drawn downwardly into the air filter 116, and the filtered air is exhausted out of the rigid enclosure's interior area 46.

In an alternate embodiment, the flexible, air-impervious curtain 160, is a single sheet of air-impervious material that is movable relative to the rigid enclosure, and the worker 40 enters the interior area 46 by moving one outer edge portion 164 of the curtain away from the rear wall 48 so as to gain access into the interior area and the working position.

Numerous modifications and variations of the spray containment enclosure assembly disclosed herein will occur to those skilled in the art in view of this disclosure. Therefore, it is to be understood that these modifications and variations, and equivalents thereof, may be practiced while remaining within the spirit and the scope of the invention as defined by the following claims.

We claim:

1. A spray containment enclosure assembly for use in a spraying operation on a work surface, comprising:

a support member;

a personnel basket supported by said support member, said personnel basket having a work area therein sized to receive a worker, said work area having a forward portion and a rearward portion, said forward portion being closer to the work surface than said rearward portion during the spraying operation, said work area having a shape and size that allows the worker to move between said forward and rearward portions;

an enclosure attached to said personnel basket, said enclosure defining an interior area, said enclosure being positioned with respect to said personnel basket such that when the worker is in said forward portion of said work area at least an upper torso of the worker is within said interior area, said enclosure having a cross member having an edge portion with a recess shaped and sized to receive therein at least a front portion of the upper torso of the worker during the spraying operation when the worker is in said forward portion of said work area, said rearward portion of said work area being exterior of said interior area such that the worker is substantially exterior of said interior area when the worker is in said rearward portion of said work area, said enclosure having an open front side to provide the worker with direct access to the work surface from said interior area, said open front side of said enclosure being positioned adjacent to the work surface during the spraying operation to define an airway gap between said enclosure and the work surface, said enclosure having an entry opening therein shaped and sized to allow the worker to move into and out of said interior area upon the worker moving between said forward and rearward portions of said work area, said enclosure having an air exhaust portion for exhausting air from said enclosure;

an air filter coupled to said enclosure;

an air moving device connected to said enclosure and coupled to said air exhaust portion to draw air into said interior area of said enclosure through said airway gap to prevent airborne particulates that are sprayed within said interior area during the spraying operation from exiting said interior area through said airway gap, said air moving device drawing air out of said interior area through said air exhaust portion, said exhausted air being passed through said air filter;

a yieldable skirt seal extending across said recess, said skirt seal being positioned to elastically deflect forwardly and sealably engage the front portion of the upper torso of the worker when the worker moves to said forward portion of said work area to substantially block airflow between the upper torso of the worker and said cross member such that a portion of the worker below said skirt seal is exterior of said interior area; and a flexible cover member attached to said enclosure and positioned to substantially cover said entry opening, said cover member being movable relative to said enclosure to allow the worker to move through said entry opening between said forward and rearward portions of said work area, said cover member being positioned to sealably engage said enclosure around said opening to form a seal therebetween, said cover member being sufficiently flexible to engage a rear portion of the upper torso of the worker upon activation of said air moving device and when the worker is in said forward portion of said work area to sealably engage the worker to substantially block air from being drawn by said air moving device into said interior area through said entry opening, such that the air drawn into said interior area substantially enters through said airway gap.

2. The spray containment enclosure assembly of claim 1, further including a control device positioned for operation by the worker while in said personnel basket, said control device being operatively connected to said support member for selectively adjusting the position of said support member and said personnel basket supported by said support member relative to the work surface.

3. The spray containment enclosure assembly of claim 1 wherein said support member is a boom arm.

4. The spray containment enclosure assembly of claim 1, further including an air filter support in said interior area of said enclosure, said air filter being removably supported by said air filter support in a position to filter the air before the air is drawn out of said interior area through said exhaust portion.

5. The spray containment enclosure assembly of claim 1 wherein said enclosure is a substantially rigid enclosure, said rigid enclosure having first and second sidewalls, a rear wall extending therebetween, a top wall attached to said first and second sidewalls and said rear wall, and a bottom wall opposite said top wall and attached to said first and second sidewalls, a portion of said rear wall being positioned between said forward and rearward portions of said personnel basket, said entry opening being in said rear wall opposite said open front side.

6. The spray containment enclosure assembly of claim 5 wherein said rear wall includes a rear upper wall portion and a rear lower wall portion, said rear upper wall portion extends downwardly from said top wall and terminates at a position above said personnel basket between said forward and rearward portions, said rear lower wall being forward of said forward portion of said personnel basket, said cross member extends between said rear lower wall portion and said rear upper wall portion, such that when the worker is in said forward position, legs of the worker are exterior of said interior area.

7. The spray containment enclosure assembly of claim 6 wherein said flexible cover member is a curtain of substantially air-impervious material, said curtain extending downwardly from said top wall to a position below said cross member to sealably engage the rear portion of the upper torso of the worker at a position below said cross member.

8. The spray containment enclosure assembly of claim 6, further comprising an air filter support attached to said first and second sidewalls, said air filter support having a forward retaining member positioned toward said bottom wall adjacent to said open front side, a rearward retaining member connected to said cross member, and a support grate extending between said forward and rearward retaining members, said support grate sloping upwardly and rearwardly from said forward retaining member to said rearward retaining member, said air filter being releasably retained by said air filter support, said air filter having top and bottom edge portions and a central portion therebetween, said top edge portion being releasably retained by said rearward retaining member, said bottom edge portion being releasably retained by said forward retaining member, and said central portion being supported by said support grate.

9. The spray containment enclosure assembly of claim 8 wherein said air exhaust portion is an aperture in said bottom wall, and said air filter is positioned between said open front side of said enclosure and said aperture so the air in said interior is drawn through said air filter before being drawn through said aperture.

10. The spray containment enclosure assembly of claim 1 wherein said enclosure has a bottom wall and said air exhaust portion is an aperture in said bottom wall, said air moving device is a fan supported in said aperture, and said air filter is positioned in said enclosure above said fan.

11. The spray containment enclosure assembly of claim 1 wherein said cross member includes a generally horizontally aligned shelf.

12. A spray containment enclosure assembly for use in a spraying operation on a work surface to contain over-spray from the spraying operation within the enclosure assembly, comprising:

a support member;

a personnel basket supported by said support member, said personnel basket having a work area therein sized to receive a worker, said work area having a forward portion and a rearward portion, said forward portion being closer to the work surface than said rearward portion during the spraying operation, said work area having a shape and size that allows the worker to move between said forward and rearward portions;

an enclosure defining an interior area, said enclosure being positioned with respect to said personnel basket such that when the worker is in said forward portion of said work area at least an upper torso of the worker is within said interior area, said enclosure having a cross member having an edge portion with a recess shaped and sized to receive therein at least a front portion of the upper torso of the worker during the spraying operation when the worker is in said forward portion of said work area, said rearward portion of said work area being exterior of said interior area such that the worker is substantially exterior of said interior area when the worker is in said rearward portion of said work area, said enclosure having an open front side to provide the worker with direct access to the work surface from said interior area, said open front side of said enclosure being positioned adjacent to the work surface during the spraying operation to define an airway gap between said enclosure and the work surface, said enclosure having an entry opening therein shaped and sized to allow the worker to move into and out of said interior area upon the worker moving between said forward and rearward portions of said work area, said enclosure having an air exhaust portion for exhausting air from said enclosure;

an air filter support member in said interior area;

an air filter releasably retained by said air filter support in a position between said open front side of said enclosure and said air exhaust portion to filter the air from said interior area before the air is exhausted through said exhaust portion;

a fan connected to said enclosure at a position to draw air into said interior area through said airway gap between said enclosure and the work surface and through said air filter for discharge through said exhaust portion to prevent airborne particulates within said interior area from exiting said interior area through said airway gap;

a yieldable skirt seal extending across said recess, said skirt seal being positioned to elastically deflect and sealably engage the front portion of the upper torso of the worker when the worker moves to said forward portion to substantially block airflow between the upper torso of the worker and said edge portion of said cross member; and a flexible cover member attached to said enclosure and positioned to substantially cover said entry opening, said cover member being movable relative to said enclosure to allow the worker to move through said entry opening between said forward and rearward portions of said work area, said cover member being positioned to sealably engage said enclosure around said entry opening to form a seal therebetween, said cover member being sufficiently flexible to engage a rear portion of the upper torso of the worker upon activation of said fan and when the worker is in said forward portion of said work area to sealably engage the worker to substantially block air from being drawn by said fan into said interior area through said entry opening, such that the air drawn into said interior area substantially enters through said airway gap.

13. The spray containment enclosure assembly of claim 12, further including a control device positioned for operation by the worker in said personnel basket, said control device being operatively connected to said support member for selectively adjusting the position of said support member and said personnel basket supported by said support member relative to the work surface.

14. The spray containment enclosure assembly of claim 12 wherein said support member is a boom arm.

15. The spray containment enclosure assembly of claim 12 wherein said enclosure is a rigid enclosure, said rigid enclosure having first and second sidewalls, a rear wall extending therebetween, a top wall attached to said first and second sidewalls and said rear wall, and a bottom wall opposite said top wall and attached to said first and second sidewalls, a portion of said rear wall being positioned between said forward and rear portions of said personnel basket, said opening being in said rear wall opposite said open front side.

16. The spray containment enclosure assembly of claim 15 wherein said rear wall includes a rear upper wall portion and a rear lower wall portion, said rear upper wall portion extends downwardly from said top wall and terminates at a position above said personnel basket between said forward and rearward portions, said rear lower wall being forward of said forward portion of said personnel basket, said cross member extends between said rear lower wall portion and said rear upper wall portion, such that when the worker is in said forward position, legs of the worker are exterior of said interior area.

17. The spray containment enclosure assembly of claim 16 wherein said flexible cover member is a curtain of substantially air-impervious material, said curtain extending downwardly from said top wall to a position below said cross member to engage the rear portion of the upper torso of the worker at a position below said cross member.

18. The spray containment enclosure assembly of claim 16 wherein said air filter support has a forward retaining member positioned toward said bottom wall adjacent to said open front side, a rearward retaining member connected to said cross member and a support grate extending between said forward and rearward retaining members, said support grate sloping upwardly and rearwardly from said forward retaining member to said rearward retaining member, said air filter being releasably retained by said air filter support, said air filter having top and bottom edge portions and a central portion therebetween, said top edge portion being releasably retained by said rearward retaining member, said bottom edge portion being releasably retained by said forward retaining member, and said central portion being supported by said support grate.

19. The spray containment enclosure assembly of claim 18 wherein said air exhaust portion is an aperture in said bottom wall, and said air filter is positioned between said open front side of said enclosure and said aperture so the air in said interior area is drawn through said air filter before being drawn through said aperture.

20. The spray containment enclosure assembly of claim 12 wherein said enclosure has a bottom wall and said air exhaust portion is an aperture in said bottom wall, and said fan is supported in said aperture, and said air filter is positioned in said enclosure above said fan.

21. A spray containment enclosure assembly for use with a personnel basket in a spraying operation on a work surface, the personnel basket having a work area therein sized to receive a worker, the personnel basket having a forward portion and a rearward portion, the personnel basket having a shape and size that allows the worker to move between the forward and rearward portions, comprising:

an enclosure attachable to the personnel basket, said enclosure having left and right sidewalls, a rear upper wall extending between said left and right sidewalls, a top wall attached to said left and right sidewalls and said top wall, a rear lower wall extending between said left and right sidewalls, a cross member attached to said rear lower wall and to said rear upper wall, and a bottom wall attached to said left and right sidewalls, said rear upper wall being rearwardly disposed from said rear lower wall with a space therebetween, said cross member extending between said rear lower wall and said rear upper wall and spanning across said space, said enclosure having an interior area defined by said right and left sidewalls, said top wall, said rear upper wall, said rear lower wall, said cross member, and said bottom wall, said cross member having an edge portion with a recess shaped and sized to receive therein at least a front portion of the upper torso of the worker when the worker is in the forward portion of the personnel basket with legs of the worker being exterior of said interior area, said enclosure having an entry opening therein shaped and sized to allow the upper torso of the worker to move into and out of said interior area upon the worker moving between the forward and rearward portions of the personnel basket;

an air moving device connected to said enclosure and adapted to create a negative pressure within said interior area relative to ambient pressure;

a yieldable skirt seal extending across said recess, said skirt seal being positioned to elastically deflect forwardly and sealably engage the front portion of the upper torso of the worker when the worker moves to the forward portion of the personnel basket to substantially block airflow between the upper torso of the worker and said cross member such that a portion of the worker below said skirt seal is exterior of said interior area; and a flexible cover member attached to said enclosure and positioned to substantially cover said entry opening, said cover member being movable relative to said enclosure to allow the worker to move through said entry opening, said cover member being positioned to sealably engage said enclosure around said entry opening to form a seal therebetween, said cover member being sufficiently flexible to engage a rear portion of the upper torso of the worker when the worker is in the forward portion of the personnel basket to sealably engage the worker to substantially block air from being drawn by said air moving device into said interior area through said entry opening.

22. The spray containment enclosure assembly of claim 21 further including an air filter in said interior area of said enclosure, said enclosure having an exhaust portion for exhausting air out of said interior area, said air filter being positioned to filter the air before the air is drawn out of said interior area through said exhaust portion.

23. The spray containment enclosure assembly of claim 22, further comprising an air filter support attached to said first and second sidewalls, said air filter support having a forward retaining member positioned toward said bottom wall adjacent to said open front side, a rearward retaining member positioned toward said rear wall and above said forward retaining member, and a support grate extending between said forward and rearward retaining members, said support grate sloping upwardly and rearwardly from said forward retaining member to said rearward retaining member, said air filter being releasably retained by said air filter support, said air filter having top and bottom edge portions and a filter portion therebetween, said top edge portion being releasably retained by said rearward retaining member, said bottom edge portion being releasably retained by said forward retaining member, and said filter portion being supported by said support grate.

24. The spray containment enclosure assembly of claim 21 wherein said enclosure has personnel basket retaining members thereon, said retaining members being removably attachable to said personnel basket.

25. The spray containment enclosure assembly of claim 21 wherein said enclosure is a substantially rigid enclosure.

26. The spray containment enclosure assembly of claim 21, wherein said entry opening is in said rear upper wall.

27. The spray containment enclosure assembly of claim 21 wherein said flexible cover member is a curtain of substantially air-impervious material, said curtain extending downwardly from said top wall to a position below said cross member such that said curtain sealably engages the rear portion of the torso of the worker at a position below said cross member.

28. The spray containment enclosure of claim 21 wherein said cross member is a generally horizontally aligned shelf extending across said interior area of said enclosure.

29. A spray containment enclosure assembly for use in a spraying operation of a work surface to contain over-spray from the spraying operation within the enclosure assembly, comprising:

a positionable support member;

a personnel basket directly supported by said support member, said personnel basket having a work area therein sized to receive a worker, said personnel basket having a work platform positioned to support the worker in said work area, said work area having a forward portion and a rearward portion, said forward portion facing the work surface during the spraying operation and said work platform supporting the worker in a working position in said forward portion of said work area during the spraying operation, said work area in said personnel basket having a shape and size that allows the worker to move between said forward and rearward portions;

portion being releasably retained by said rearward retaining member, said bottom edge portion being releasably retained by said forward retaining member, and said central portion being supported by said support grate.

9. The spray containment enclosure assembly of claim 8 wherein said air exhaust portion is an aperture in said bottom wall, and said air filter is positioned between said open front side of said enclosure and said aperture so the air in said interior is drawn through said air filter before being drawn through said aperture.

10. The spray containment enclosure assembly of claim 1 wherein said enclosure has a bottom wall and said air exhaust portion is an aperture in said bottom wall, said air moving device is a fan supported in said aperture, and said air filter is positioned in said enclosure above said fan.

11. The spray containment enclosure assembly of claim 1 wherein said cross member includes a generally horizontally aligned shelf.

12. A spray containment enclosure assembly for use in a spraying operation on a work surface to contain over-spray from the spraying operation within the enclosure assembly, comprising:

a support member;

a personnel basket supported by said support member, said personnel basket having a work area therein sized to receive a worker, said work area having a forward portion and a rearward portion, said forward portion being closer to the work surface than said rearward portion during the spraying operation, said work area having a shape and size that allows the worker to move between said forward and rearward portions;

an enclosure defining an interior area, said enclosure being positioned with respect to said personnel basket such that when the worker is in said forward portion of said work area at least an upper torso of the worker is within said interior area, said enclosure having a cross member having an edge portion with a recess shaped and sized to receive therein at least a front portion of the upper torso of the worker during the spraying operation when the worker is in said forward portion of said work area, said rearward portion of said work area being exterior of said interior area such that the worker is substantially exterior of said interior area when the worker is in said rearward portion of said work area, said enclosure having an open front side to provide the worker with direct access to the work surface from said interior area, said open front side of said enclosure being positioned adjacent to the work surface during the spraying operation to define an airway gap between said enclosure and the work surface, said enclosure having an entry opening therein shaped and sized to allow the worker to move into and out of said interior area upon the worker moving between said forward and rearward portions of said work area, said enclosure having an air exhaust portion for exhausting air from said enclosure;

an air filter support member in said interior area;

an air filter releasably retained by said air filter support in a position between said open front side of said enclosure and said air exhaust portion to filter the air from said interior area before the air is exhausted through said exhaust portion;

a fan connected to said enclosure at a position to draw air into said interior area through said airway gap between said enclosure and the work surface and through said air filter for discharge through said exhaust portion to prevent airborne particulates within said interior area from exiting said interior area through said airway gap;

a yieldable skirt seal extending across said recess, said skirt seal being positioned to elastically deflect and sealably engage the front portion of the upper torso of the worker when the worker moves to said forward portion to substantially block airflow between the upper torso of the worker and said edge portion of said cross member; and a flexible cover member attached to said enclosure and positioned to substantially cover said entry opening, said cover member being movable relative to said enclosure to allow the worker to move through said entry opening between said forward and rearward portions of said work area, said cover member being positioned to sealably engage said enclosure around said entry opening to form a seal therebetween, said cover member being sufficiently flexible to engage a rear portion of the upper torso of the worker upon activation of said fan and when the worker is in said forward portion of said work area to sealably engage the worker to substantially block air from being drawn by said fan into said interior area through said entry opening, such that the air drawn into said interior area substantially enters through said airway gap.

13. The spray containment enclosure assembly of claim 12, further including a control device positioned for operation by the worker in said personnel basket, said control device being operatively connected to said support member for selectively adjusting the position of said support member and said personnel basket supported by said support member relative to the work surface.

14. The spray containment enclosure assembly of claim 12 wherein said support member is a boom arm.

15. The spray containment enclosure assembly of claim 12 wherein said enclosure is a rigid enclosure, said rigid enclosure having first and second sidewalls, a rear wall extending therebetween, a top wall attached to said first and second sidewalls and said rear wall, and a bottom wall opposite said top wall and attached to said first and second sidewalls, a portion of said rear wall being positioned between said forward and rear portions of said personnel basket, said opening being in said rear wall opposite said open front side.

16. The spray containment enclosure assembly of claim 15 wherein said rear wall includes a rear upper wall portion and a rear lower wall portion, said rear upper wall portion extends downwardly from said top wall and terminates at a position above said personnel basket between said forward and rearward portions, said rear lower wall being forward of said forward portion of said personnel basket, said cross member extends between said rear lower wall portion and said rear upper wall portion, such that when the worker is in said forward position, legs of the worker are exterior of said interior area.

17. The spray containment enclosure assembly of claim 16 wherein said flexible cover member is a curtain of substantially air-impervious material, said curtain extending downwardly from said top wall to a position below said cross member to engage the rear portion of the upper torso of the worker at a position below said cross member.

18. The spray containment enclosure assembly of claim 16 wherein said air filter support has a forward retaining member positioned toward said bottom wall adjacent to said open front side, a rearward retaining member connected to said cross member and a support grate extending between said forward and rearward retaining members, said support